US009334678B2

(12) United States Patent
Allen

(10) Patent No.: US 9,334,678 B2
(45) Date of Patent: May 10, 2016

(54) LOCK WITH FLEXIBLY OBEDIENT SECURING ARM

(71) Applicant: FLEXLOCK, LLC, Richardson, TX (US)

(72) Inventor: Frank P. Allen, Dallas, TX (US)

(73) Assignee: FlexLock, LLC, Richardson, TX (US)

( * ) Notice: Subject to any disclaimer, the term of this patent is extended or adjusted under 35 U.S.C. 154(b) by 0 days.

(21) Appl. No.: 14/811,688

(22) Filed: Jul. 28, 2015

(65) Prior Publication Data

US 2016/0024818 A1 Jan. 28, 2016

Related U.S. Application Data

(60) Provisional application No. 62/029,616, filed on Jul. 28, 2014, provisional application No. 62/109,539, filed on Jan. 29, 2015.

(51) Int. Cl.

| | |
|---|---|
| ***E05B 67/06*** | (2006.01) |
| ***E05B 67/00*** | (2006.01) |
| ***E05B 71/00*** | (2006.01) |

(Continued)

(52) U.S. Cl.

CPC ..... *E05B 67/003* (2013.01); *E05B 71/00* (2013.01); *E05B 73/0005* (2013.01); *D07B 2201/2067* (2013.01); *E05B 37/0068* (2013.01)

(58) Field of Classification Search

CPC ..... E05B 67/00; E05B 67/003; E05B 67/06; E05B 69/00; E05B 71/00; E05B 73/00; E05B 73/0005; D07B 1/00; D07B 1/005; D07B 2201/20; D07B 2201/2001; D07B 2201/2009; D07B 2201/2014; D07B 2201/2047; D07B 2201/2052; D07B 2201/2055; D07B 2201/2066; D07B 2201/2067; D07B 2201/2068; D07B 2201/2089; D07B 2201/209; D07B 2201/20903

See application file for complete search history.

(56) References Cited

U.S. PATENT DOCUMENTS 925,317 A 6/1909 Eldred
3,933,015 A * 1/1976 Balicki ..... E05B 67/003 70/18

(Continued)

OTHER PUBLICATIONS

SnakeClamp Products, LLC, Gooseneck & Rigid Arms for Your SnakeClamp, http://snakeclamp.com/Category/flexible-metal-gooseneck-hose-arm, accessed via Web Jul. 22, 2015 (partial pages).

(Continued)

*Primary Examiner* — Christopher Boswell
(74) *Attorney, Agent, or Firm* — Howison & Arnott, L.L.P.

(57) ABSTRACT

A bicycle lock apparatus comprises a locking mechanism selectively changeable between locked and unlocked configurations and an elongated securing arm. The securing arm includes a first end adapted for removable insertion into the locking mechanism it is unlocked, and for non-removable connection when it is locked. The securing arm further includes an armored sheath extending a length of at least seven feet and having an annular wall formed from at least two spirally-wound metallic strips interwound with one another to define a continuous interior cavity. The armored sheath is flexibly obedient to be reconfigurable into curved positions and holds the positions after the bending force is removed. The securing arm further includes a reinforcing core disposed within the interior cavity, the reinforcing core including at least one bundle of elongated non-metallic fiber material having a tensile strength-to-weight ratio of at least 1000 kN·m/Kg extending between the first and second ends.

19 Claims, 11 Drawing Sheets

(51) Int. Cl.
*E05B 73/00* (2006.01)
*E05B 37/00* (2006.01)

(56) References Cited

U.S. PATENT DOCUMENTS 3,991,594 A 11/1976 Goenner
4,075,878 A * 2/1978 Best ..... E05B 67/003 70/369
4,177,541 A * 12/1979 Seakan ..... E05B 73/0005 24/122.3
4,407,065 A * 10/1983 Gray ..... G02B 6/443 156/54
5,406,810 A * 4/1995 Chen ..... E05B 67/003 70/18
5,447,043 A * 9/1995 Hwang ..... E05B 67/003 70/386
8,429,940 B2 * 4/2013 Evans ..... E05B 67/003 70/360
9,243,428 B1 * 1/2016 Miracle ..... E05B 71/00
2005/0183475 A1 * 8/2005 Liu ..... E05B 67/003 70/49
2008/0276664 A1 * 11/2008 Shu ..... E05B 67/003 70/18
2010/0093448 A1 4/2010 Markham
2012/0067020 A1 * 3/2012 Paddock ..... D07B 1/025 57/17
2015/0107866 A1 * 4/2015 Lee ..... H01B 9/008 174/6
2015/0184336 A1 * 7/2015 Chuang ..... D07B 1/10 361/679.56

OTHER PUBLICATIONS

SnakeClamp Products, LLC, Gooseneck & Rigid Arms for Your SnakeClamp, http://snakeclamp.com/Category/flexible-metal-gooseneck-hose-arm, accessed via Web Oct. 30, 2015.
Specific Strength, Wikipedia the Free Encyclopedia, https://en.wikipedia.org/wiki/Specific_strength, accessed via Web Jul. 28, 2015, pp. 2-4.

* cited by examiner

LOCK WITH FLEXIBLY OBEDIENT SECURING ARM

CROSS-REFERENCE TO RELATED APPLICATIONS

This application claims benefit of U.S. Provisional Application No. 62/029,616, filed on Jul. 28, 2014, entitled FLEX-LOCK, A FLEXIBLY OBEDIENT LOCKING SYSTEM FOR THE SECURING OF BICYCLES AND OTHER PROPERTY, and also claims benefit of U.S. Provisional Application No. 62/109,539, filed on Jan. 29, 2015, entitled FLEXIBLY OBEDIENT SHACKLE-STYLE LOCKING SYSTEM FOR BICYCLES AND OTHER PROPERTY. U.S. Application Nos. 62/029,616 and 62/109,539 are incorporated by reference in their entirety.

TECHNICAL FIELD

The present invention relates to locks for bicycles and other movable articles. More specifically, to locks having a securing arm that is flexibly obedient, i.e., a securing arm that is reconfigurable into multiple curved positions by the manual application of bending force, and that holds any of said positions after the bending force is removed until it is bent again.

BACKGROUND

For many years, the most common locks for securing of bicycles in public have been two general types of locking systems, namely, the "U-bar" lock and the "recoiling cable" lock.

Although many companies manufacture U-bar lock systems, most are simply variations an inflexible metal shackle in the shape of a "U" that inserts into a perpendicular crossbar containing a locking mechanism. As is well documented, standard U-bar locks offer very limited security, since they are only large enough to simultaneously secure the bicycle frame and, depending on bicycle design and proximity of securing object, one wheel/tire. This typically leaves at least one wheel/tire and the seat vulnerable to theft. Often times both wheel/tires are unsecured. In order to fully secure all components of a bicycle with a U-bar lock, additional security products, such as steel cables, must be purchased. Generally, U-bar locks are also heavy (average weight: 3 pounds), clunky, aesthetically displeasing, devoid of flexibility, versatility and ergonomics, and are quickly undermined by a variety of cutting tools and other common lock disarming methods employed by thieves such as standard-size bolt-cutters or hacksaws.

As with U-bar locks, many companies manufacture recoiling cable locks, most of which are simply variations of a self-recoiling braided steel cable encased in either plastic, vinyl or rubber, capped by a locking mechanism on one end, and a locking stem insert on the other. As is well documented, standard recoiling cable locks offer extremely limited security. With an average length between five and six feet, most are too short to secure the bicycle frame, both wheels/tires and the seat simultaneously, requiring the purchase of additional security products. Recoiling cable locks are so easily undermined by standard bolt cutters; thus they are often referred to as "gone in sixty seconds" locks. Recoiling cable locks also tangle easily, are aesthetically displeasing, and the exterior coverings may collect excessive amounts of dirt and grime to the point where they may become sticky and unusable.

There are some alternative locking products designed for bicycle security, including heavy steel chains (average weight: 10 pounds), short hard-cable locks (which only secure the bicycle frame and may be as quickly undermined as standard recoiling cable locks), and a variety of products which provide little to no security, for example, a hand-size, thin braided steel retractable cable (easily undermined with standard wire cutters) and "cuffs" (which only secure the bicycle frame). Although there is no such thing as "total security," all of the locking systems described above suffer from major design and engineering flaws, require the purchase of additional security items (and usually, mounting clips or devices for transport). Further, after many years on the market, thieves have mastered the skills needed to quickly undermine such existing lock systems.

The present invention seeks to provide an innovative locking system that combines enhanced security, unmatched flexibility, ergonomics and aesthetics for near-total security of bicycles and other property.

SUMMARY

Locks in accordance with the current disclosure seek to provide a number of innovations and improvements that address the shortcomings of presently existing U-bar shackle locks and recoiling cable locks, while also enhancing security, flexibility, increased proximity options, ergonomics and aesthetics.

In one aspect thereof, a unique, innovative, non-recoiling cable-style locking system is provided for bicycles and other property. The locking system is designed to not only address the flaws of available locking systems, but also the need for additional security and mounting item purchase, and further to be lightweight, virtually indestructible, uniquely flexible, ergonometric and aesthetically pleasing. In some embodiments, multiple locks are sequentially interlockable (i.e., "daisy-chain"-able) for unlimited length potential.

In another aspect thereof, the lock apparatus comprises a cut-resistant carbon-Kevlar and/or metal core encased in cut-resistant flexible gooseneck tubing, which allows the lock apparatus to bend into and hold any shape without loss of security integrity. In some embodiments, the lock is longer and thicker than available products in order to prevent undermining by standard cutting tools while still allowing for the securing of a bicycle frame, both wheels/tires and seat without the need for additional security purchase. In some embodiments, the lock apparatus includes a unique "set your own combination" locking mechanism that allows for the interlocking of multiple copies of the lock to one another for unlimited length potential. Some embodiments of the lock may be weather-resistant and may feature a unique, scratch-resistant color finish treatment. Some embodiments of the lock will be packaged in a unique "tube" which includes a detachable shoulder-strap for ease of transport.

In yet another aspect thereof, a lock apparatus is disclosed for securing one or more objects to be secured to a stationery object. The lock apparatus comprises a locking mechanism and an elongated securing arm. The locking mechanism includes a body; a stem receptacle portion disposed in the body and having an internal profile changeable between a locked profile and an unlocked profile; an actuator portion disposed on the body and having a configuration selectively movable between a locked configuration and an unlocked configuration, the actuator portion being operatively connected to the stem receptacle portion to change the internal profile of the stem receptacle portion into the locked profile when the actuator portion is moved to the locked configuration and to change the internal profile of the stem receptacle portion into the unlocked profile when the actuator portion is moved to the unlocked configuration. The securing arm includes a first end having a stem portion configured for removable insertion into the stem receptacle portion of the locking mechanism, the stem portion, when inserted into the stem receptacle portion, being removable from the stem receptacle portion when the internal profile is the unlocked profile, and the stem portion, when inserted into the stem receptacle portion, being non-removably connected to the stem receptacle portion when the internal profile is the locked profile. The securing arm further comprises a second end spaced apart from the first end, the second end being connected to the body of the locking mechanism. The securing arm further comprises an armored sheath extending between the first end and the second end, the armored sheath being formed of flexible metallic tubing having an annular wall defining a continuous interior cavity, the annular wall of the flexible metallic tubing including at least two helically-wound metallic wires, rods, strips or ribbons interwound with one another such that successive coils of a first wire, rod, strip or ribbon are interleaved with successive coils of a second wire, rod, strip or ribbon to form a cross-sectional configuration. The cross-sectional configuration of the flexible metallic tubing is flexibly obedient such that the armored sheath is reconfigurable into multiple curved positions by the manual application of bending force and holds the curved positions after the bending force is removed until it is manually bent again. The cross-sectional configuration of the flexible metallic tubing further defines an outer diameter and an inner diameter of the armored sheath. The securing arm further comprises a reinforcing core disposed within the interior cavity of the armored sheath between the first end and the second end, the reinforcing core having an outer diameter and including at least one bundle of non-metallic fiber material having a tensile strength-to-weight ratio of at least 1000 kN·m/Kg, and the reinforcing core being sufficiently flexible to maintain the curved positions of the flexibly-obedient armored sheath after the bending force is removed.

In one embodiment thereof, the annular wall of the flexible metallic tubing includes a base-wire coil formed of a helically-wound metallic wire having a round cross-section and a packing-wire coil formed of a helically-wound metallic strip having a triangular cross-section, wherein the base-wire coil and the packing-wire coil are interleaved with an apex of the triangular cross-section of the packing-wire coil inwardly oriented toward a centerline of the flexible metallic tubing between directly successive turns of the base-wire coil.

In another embodiment thereof, the reinforcing core further comprises at least one bundle of metallic wire and the bundle of metallic wire is twisted with the bundle of non-metallic fiber material to form a rope of metallic wire and non-metallic fiber material.

In still another embodiment thereof, the reinforcing core further comprises an inner core including at least one bundle of metallic wire and an outer core including a plurality of bundles of non-metallic fiber material having a tensile strength-to-weight ratio of at least 1000 kN·m/Kg woven around the metallic wire of the inner core.

In yet another embodiment thereof, the reinforcing core further comprises an inner core formed from a plurality of bundles of metallic wire or non-metallic fiber material having a tensile strength-to-weight ratio of at least 1000 kN·m/Kg twisted into a rope and an outer core formed from a plurality of bundles of metallic wire or non-metallic fiber material having a tensile strength-to-weight ratio of at least 1000 kN·m/Kg woven around the rope of the inner core.

In a preferred embodiment thereof, the helically-wound metallic wires, rods, strips or ribbons of the annular wall of the flexible metallic tubing are formed of steel, at least some of the bundles of the inner core are formed of steel wire, and at least some of the bundles of the outer core are formed of an aramid or para-aramid fiber material.

In a further embodiment thereof, the annular wall of the flexible metallic tubing includes a pair of spirally-wound metallic strips having sliding joints between adjacent turns thereof formed by overlapping and crimping or interlocking adjacent edges.

In another embodiment thereof, the reinforcing core further comprises at least one bundle of metallic wire or another bundle of non-metallic fiber having a tensile strength-to-weight ratio of at least 1000 kN·m/Kg and the bundles are twisted together to form a rope.

In still another embodiment thereof, the reinforcing core further comprises an inner core including at least one bundle of metallic wire and an outer core including a plurality of bundles of metallic wire or non-metallic fiber material having a tensile strength-to-weight ratio of at least 1000 kN·m/Kg woven around the metallic wire of the inner core.

In yet another embodiment thereof, the reinforcing core further comprises an inner core formed from a plurality of bundles of metallic wire or non-metallic fiber material having a tensile strength-to-weight ratio of at least 1000 kN·m/Kg twisted into a rope and an outer core formed from a plurality of bundles of metallic wire or non-metallic fiber material having a tensile strength-to-weight ratio of at least 1000 kN·m/Kg woven around the rope of the inner core.

In a further embodiment thereof, the actuator portion of the locking mechanism comprises a key-operated pin-tumbler lock.

In another embodiment thereof, the actuator portion of the locking mechanism comprises a multiple-dial combination lock.

In still another embodiment thereof, the body defines a longitudinal axis passing therethrough, and at least one of the first and second ends of the flexibly-obedient securing arm is connected to the body in a direction perpendicular to the longitudinal axis, thereby constituting a shackle-type lock.

In yet another embodiment thereof, the body defines a longitudinal axis passing therethrough, and both the first and second ends of the flexibly-obedient securing arm are connected to the body in a direction parallel to the longitudinal axis, thereby constituting a cable-type lock.

In still another aspect thereof, a lock apparatus is disclosed for securing one or more objects to be secured to a stationery object. The lock apparatus comprises a locking mechanism and an elongated flexibly-obedient securing arm. The locking mechanism includes an actuator portion operatively connected to a stem receptacle portion to change an internal profile of the stem receptacle portion into a locked profile when the actuator portion is moved into a locked configuration and to change the internal profile of the stem receptacle portion into an unlocked profile when the actuator portion is moved to an unlocked configuration. The elongated securing arm includes a first end having a stem portion configured for removable insertion into the stem receptacle portion of the locking mechanism, the stem portion being removable from the stem receptacle portion when the internal profile is the unlocked profile, but being non-removably connected to the stem receptacle portion when the internal profile is the locked profile. The securing arm further comprises a second end spaced apart from the first end, the second end being connected to the body of the locking mechanism. The securing arm further comprises an armored sheath extending between the first end and the second end, the armored sheath having an annular wall defining a continuous interior cavity and including at least two spirally-wound metallic strips interwound with one another to form a cross-sectional configuration, the cross-sectional configuration of the armored sheath being flexibly obedient such that the armored sheath is reconfigurable into multiple curved positions by the manual application of bending force and holds the curved positions after the bending force is removed until it is manually bent again. The cross-sectional configuration of the armored sheath further defines an outer diameter and an inner diameter. The securing arm further comprises a reinforcing core disposed within the interior cavity of the armored sheath between the first and second ends, the reinforcing core having an outer diameter within the range from 75% to 98% of the inner diameter of the armored sheath and including at least one bundle of elongated non-metallic fiber material having a tensile strength-to-weight ratio of at least 1000 kN·m/Kg extending between the first and second ends.

In one embodiment thereof, the armored sheath of the flexibly-obedient securing arm has an outer diameter of 20 mm or greater.

In another embodiment thereof, the armored sheath of the flexibly-obedient securing arm is formed from at least one of steel, stainless steel, magnesium steel, titanium, iron, brass, bronze and tin.

In still another embodiment thereof, the reinforcing core is formed from at least one of steel wire, braided steel wire, titanium wire, glass fiber, carbon fiber, aramid fiber, para-aramid fiber and poly paraphenylene terephthalamide fiber.

In yet another aspect thereof, a bicycle lock apparatus for securing a bicycle to a stationery object is disclosed, the bicycle lock apparatus comprising a locking mechanism selectively changeable between a locked configuration and an unlocked configuration and an elongated securing arm. The securing arm includes a first end adapted for removable insertion into the locking mechanism when the locking mechanism is in the unlocked configuration, but for non-removable connection to the locking mechanism when the locking mechanism is in the locked configuration. The securing arm further includes a second end spaced apart from the first end and connected to the locking mechanism. The securing arm further includes an armored sheath extending a length of at least seven feet between the first end and the second end, the armored sheath having an annular wall formed from at least two spirally-wound metallic strips interwound with one another to define a continuous interior cavity, the armored sheath being flexibly obedient such that the armored sheath is reconfigurable into multiple curved positions by the manual application of bending force and holds the curved positions after the bending force is removed until it is manually bent again, the armored sheath further defining an outer diameter and an inner diameter. The securing arm further includes a reinforcing core disposed within the interior cavity of the armored sheath between the first and second ends, the reinforcing core including at least one bundle of elongated non-metallic fiber material having a tensile strength-to-weight ratio of at least 1000 kN·m/Kg extending between the first and second ends.

BRIEF DESCRIPTION OF THE DRAWINGS

For a more complete understanding, reference is now made to the following description taken in conjunction with the accompanying Drawings in which.

DETAILED DESCRIPTION

Figure 1:
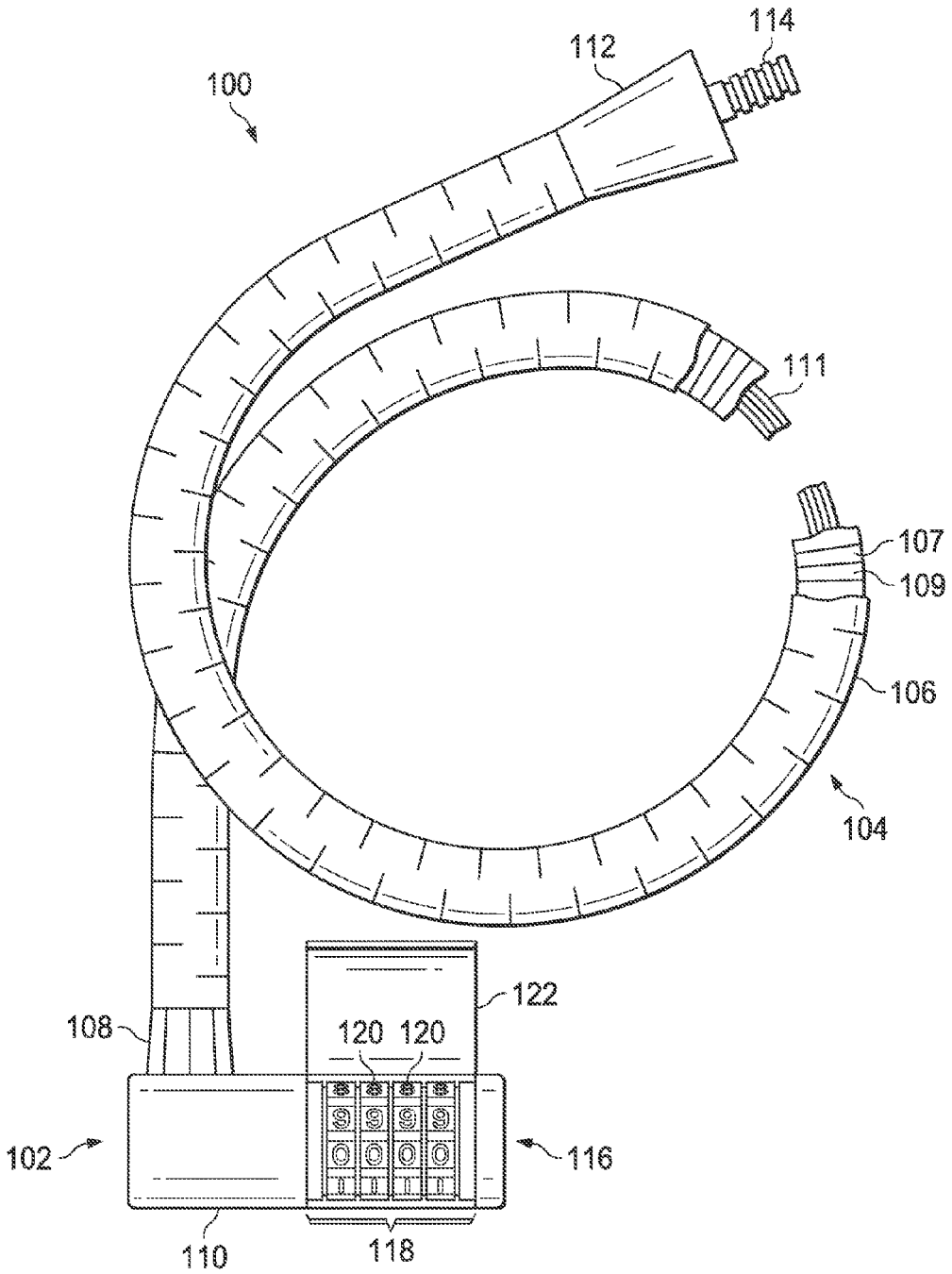
FIG. 1 shows a front view with portions broken away of a shackle-style lock with a flexibly-obedient securing arm in accordance with one embodiment, the lock being in an unlocked condition.

Referring now to the drawings, wherein like reference numbers are used herein to designate like elements throughout, the various views and embodiments of a lock with flexibly obedient securing arm are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Figure 2:
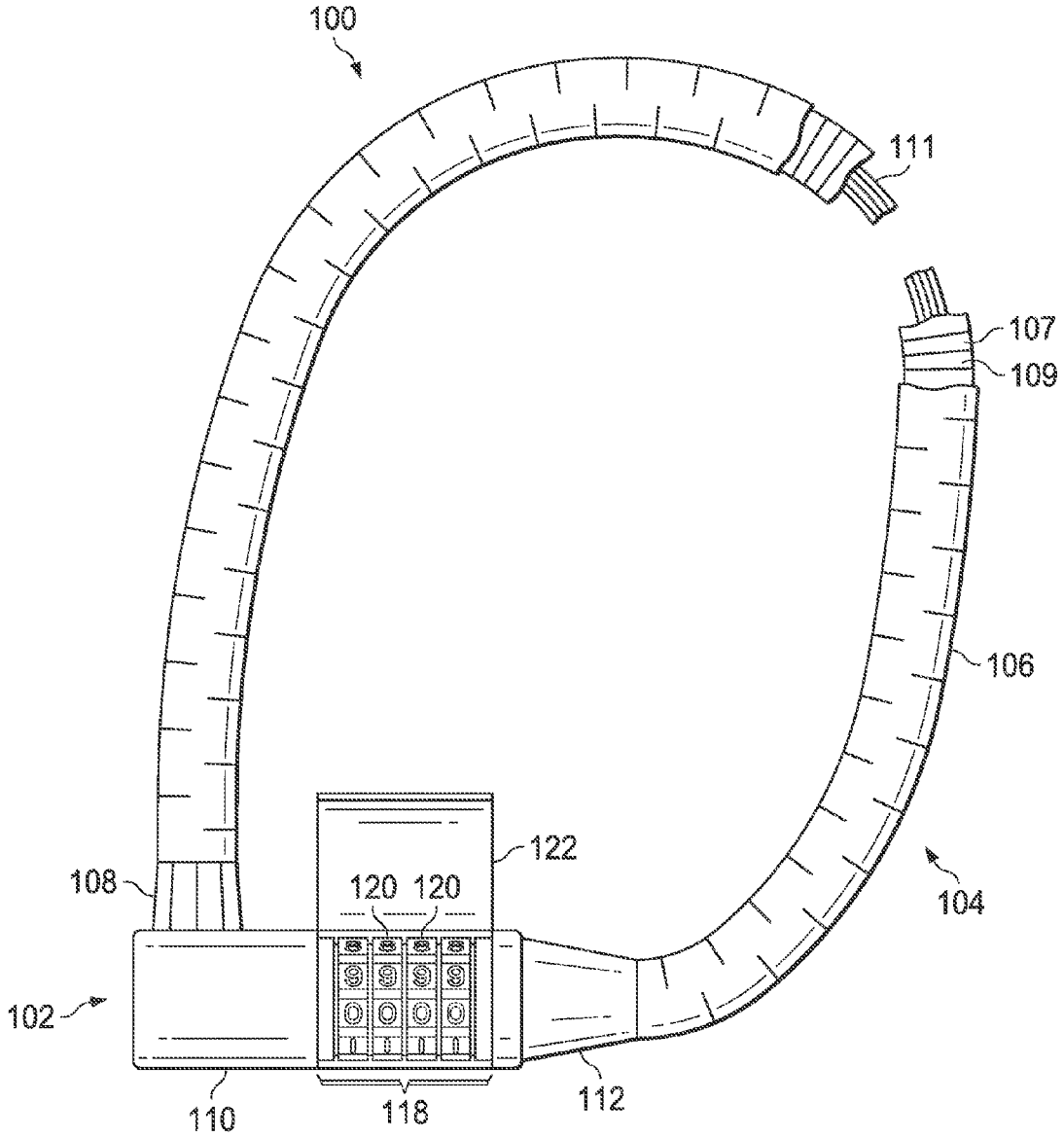
FIG. 2 shows the shackle-style lock of FIG. 1, the lock being in a locked condition.
Figure 3:
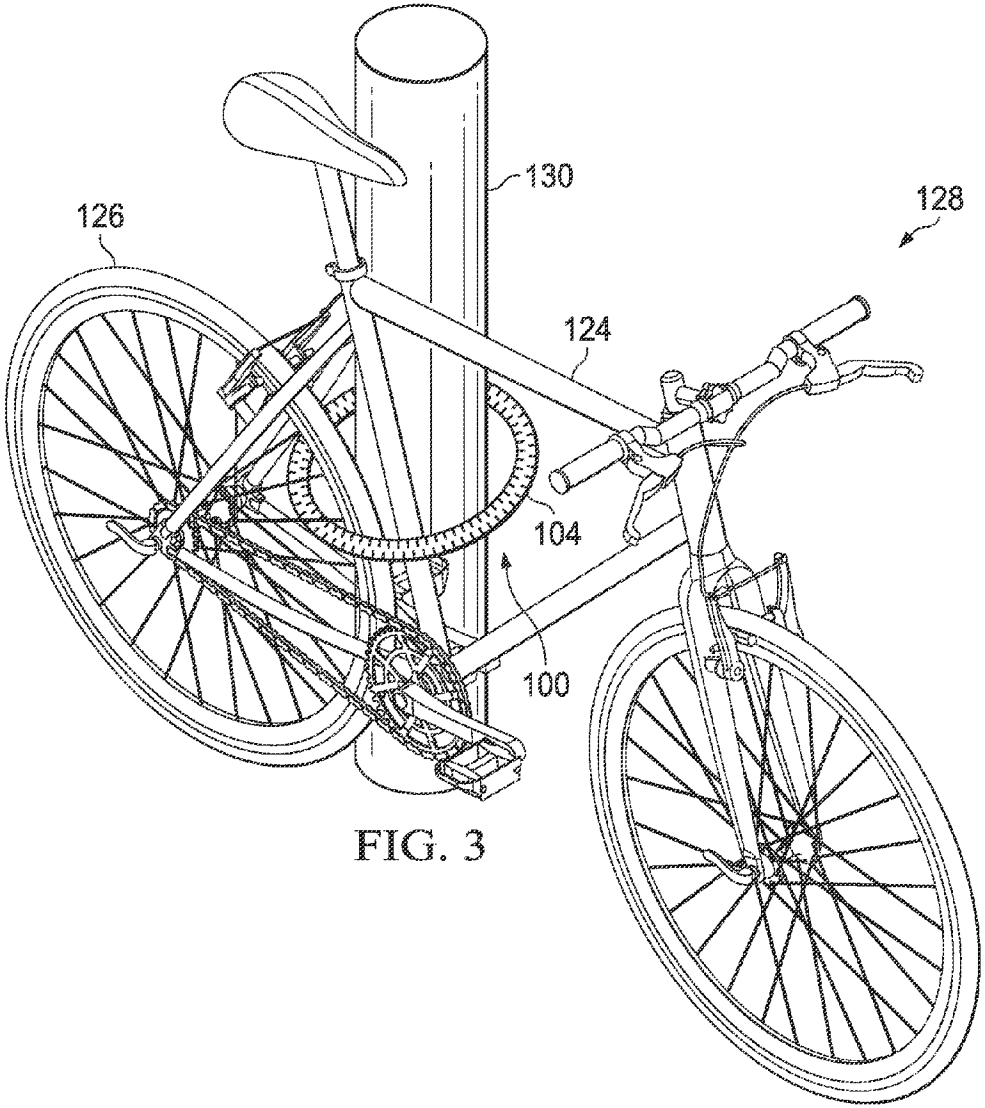
FIG. 3 illustrates the shackle-style lock of FIG. 1 being used to secure a bicycle to an object in accordance with another aspect.

Referring now to FIGS. 1-3, there is illustrated a lock with flexibly-obedient securing arm in accordance with one aspect. The lock 100 is a shackle-style lock suitable for use as a bicycle lock. FIG. 1 presents a view of the lock 100 as it would appear upon removal from retail packaging. The lock 100 includes a lock mechanism 102 and a flexibly-obedient securing arm 104. For purposes of illustration, the securing arm is illustrated with portions broken away to show internal structure and with a break to indicate that the securing arm 104 may have a range of lengths in different embodiments. Preferred lengths for the securing arm 104 are 24 inches, 30 inches and 36 inches; however, other embodiments may have securing arm lengths of 84 inches (7 feet), 180 inches (15 feet) and other lengths. As further described herein (see FIG. 6), certain embodiments of the disclosed lock apparatus may be connected together in a "daisy chain" arrangement to produce overall securing arm lengths in multiples of the individual arm lengths. FIG. 1 also illustrates that the flexibly-obedient securing arm 104 may bend into any shape and will maintain such shape when the bending force is removed.

The flexibly-obedient property (also known as the "stay-put" property) of the securing arm 104 results from the cross-sectional structure of the securing arm (see, e.g., FIGS. 9-14). In particular, the flexibly-obedient property results from a tubular structure formed by interwinding two or more helically-wound or spirally-wound wires, rods, strips or ribbons (collectively "coil elements"). A variety of different flexibly-obedient tube structures employing multiple interwound coil elements are known; and such tube structures are often referred to as "gooseneck tubes" or "gooseneck cables." In some embodiments, the coil elements of the tubular structure may have simple cross-sections, e.g., circular, triangular, rectangular, whereas in other embodiments, the coil elements may have complex cross-sections with interconnecting lips, flanges, or other connecting structures. In some embodiments, the cross-sections of the two coil elements may be the same, whereas in other embodiments, the cross-sections of the two coil elements may be different. Static friction between the interwound coil elements forming the tubular structure allows the tubular structure to maintain any shape until application of a bending force which exceeds the localized static friction (known as the "minimum bending force"). When a force of at least the minimum bending force is applied to a portion of the tubular structure, the static friction between the coil elements is overcome, and the coil elements can move relative to one another to allow the tubular structure to bend into a new shape. When the bending force drops below the minimum bending force, the tubular structure maintains whatever shape it is in, for as long as the bending force does not again exceed the minimum bending force.

It will be appreciated that bending a flexibly-obedient tubular structure formed from interwinding two or more helically-wound or spirally-wound coil elements does not result in permanent deformation of the coil elements; rather the coil elements just move relative to one another. This behavior is in contrast with other types of flexible tubes, e.g., corrugated conduit, wherein the bending of the tube results in permanent deformation of the wall elements. Accordingly, a flexibly-obedient structure formed from interwinding two or more helically-wound or spirally-wound coil elements has a greatly reduced tendency to fatigue and break from repeated bending and repositioning in comparison with other types of flexible tubes.

The degree of flexible-obedience provided by a particular flexibly-obedient tube structure is typically specified in terms of a weight that can be placed at the end of an unsupported horizontal tube of a specified length without causing relative movement between the coil elements. This weight-and-distance parameter is sometimes known as the "horizontal load capacity" of a particular flexibly-obedient tube. For example, a gooseneck tube having a horizontal load capacity of 2 pounds at a length 24 inches is considered very stiff for manual bending. In comparison, a gooseneck tube having a horizontal load capacity of 0.5 pounds at a length of 18 inches is considered very comfortable for manual bending.

Referring still to FIGS. 1-3, the flexibly-obedient securing arm 104 of lock 100 in the illustrated embodiment may be fabricated from reinforced, armored flexible gooseneck tubing, constructed from a variety of metals, including but not limited to, brass, steel, magnesium steel, stainless steel, titanium, bronze, iron, tin, or any combination thereof. The flexibly-obedient securing arm 104 in the illustrated embodiment preferably measures from 1.5 feet (18 inches) to 3 feet (36 inches) in length, with an outside diameter ranging from 8 mm to 25 mm. In preferred embodiments, the securing arm 104 has an outside diameter within the range of 20 mm to 25 mm (including the end points). Other embodiments may have a securing arm 104 with a different length and/or with a different outer diameter. The exterior of the lock 100 may feature surface treatments for improved security, environmental protection and also artistic design including, but not limited to, electro-coating, plating, paints, plastics, rubber, or heat-shrink sleeve. Surface treatments are designed to resist scratching, enhance aesthetics, and improve security of the lock 100.

In the illustrated embodiment of the lock 100, the flexibly-obedient securing arm 104 comprises an armored sheath 106 fabricated from a first metallic spring 107, which may be formed from, but is not limited to, iron, steel, or any variation thereof, interwound with a second metallic spring 109. A reinforcing cord 111 (also known as a "core"), which may be fabricated from, but is not limited to, steel, braided steel, titanium wire, glass fiber, aramid fiber, para-aramid fiber, Kevlar® brand poly paraphenylene terephthalamide fiber, carbon-Kevlar®, carbon nanotubes, or any combination thereof, is threaded through the interior cavity of the springs, adding a third layer of security protection. In some embodiments, the reinforcing core 111 includes at least one bundle of non-metallic fiber material. In preferred embodiments, the non-metallic fiber material of the reinforcing core 111 includes non-metallic fiber material having a tensile strength-to-weight ratio of at least 1000 kN·m/Kg, for example glass fibers. In more preferred embodiments, the non-metallic fiber material of the reinforcing core 111 includes non-metallic fiber material having a tensile strength-to-weight ratio of at least 2000 kN·m/Kg, for example, aramid fibers, carbon fibers (AS4) and Kevlar® brand poly paraphenylene terephthalamide fiber.

In this embodiment, one end 108 of the securing arm 104 is permanently connected to the body 110 of the locking mechanism 102. The other end 112 of the securing arm 104 includes a stem portion 114, which may be constructed from hardened steel, stainless steel, titanium, iron, or other rigid metal or metal alloy, and is configured to be removably insertable into a stem receptacle portion 116 disposed within the body 110 of the locking mechanism 102. The stem receptacle portion 116 of the locking mechanism 102 has an internal profile changeable between a locked profile and an unlocked profile. The locking mechanism 102 of this embodiment further includes an actuator portion 118 disposed on the body 110 and having a configuration selectively movable between a locked configuration and an unlocked configuration. In the illustrated embodiment, the actuator portion 118 includes a plurality of dials 120 forming a combination lock. The actuator portion 118 is operatively connected to the stem receptacle portion 116 to change the internal profile of the stem receptacle portion into the locked profile when the actuator portion is moved to the locked configuration and to change the internal profile of the stem receptacle portion into the unlocked profile when the actuator portion is moved to the unlocked configuration.

The body 110 of the lock mechanism 102 is preferably constructed from materials including, but not limited to, steel, stainless steel, or any weather- and rust-resistant combination thereof. The body 110 may be encased in a scratch-resistant cover constructed from materials including, but not limited to, rubber, foam, plastic or any combination thereof. Portions of the body 110 may be solid, or may be hollow as necessary. Hollow portions of the body 110 may house additional components (not shown) including, but not limited to, lights, alarms, GPS devices, etc. The flexibly-obedient securing arm 104 of this embodiment is permanently connected to one end of the body 110. The body 110 of the locking mechanism 102 of this embodiment houses the actuator portion 118 including a combination lock with multiple dials 120. In other embodiments, the actuator portion 118 may include a key lock, a dead bolt, or similar locking mechanism operated by inputting a resettable combination or by inserting a key from either the side and/or from the locking end of the body 110. A dust cover 122 may be provided on the locking mechanism 102 to protect the locking dials 120 from dirt and the like.

In particular, FIG. 1 shows the shackle-style lock 100 in the unlocked and open configuration, i.e., the actuator portion 118 is moved to an unlocked configuration, thereby causing the internal profile of the stem receptacle portion 116 to change to the unlocked profile such that the stem portion 114 of the flexibly-obedient securing arm 104 may be inserted and removed from the stem receptacle portion. The stem portion 114 may therefore be removed from engagement with the locking mechanism 102 so that it can be threaded through holes in objects to be secured (e.g., bicycle frame, wheels/tires, etc.) and threaded through holes in, or wound around, stationery objects such as poles, fences, bicycle stands, etc.

In particular, FIG. 2 shows the shackle-style lock 100 in the locked and closed configuration, i.e., the stem portion 114 of the flexibly-obedient securing arm 104 is inserted in the stem receptacle portion 116 of the locking mechanism 102 and the actuator portion 118 is moved to an locked configuration, thereby causing the internal profile of the stem receptacle portion to change to the locked profile such that the stem portion is captured within the stem receptacle portion and may not be removed (until the locking mechanism is unlocked again). If the flexibly-obedient securing arm 104 has been threaded through holes in objects to be secured and threaded through holes in, or wound around, stationery objects such as poles, fences, bicycle stands, etc., then the object to be secured will be securely fastened to the stationery object.

In particular, FIG. 3 illustrates the flexibly-obedient securing arm 104 of the shackle-style lock 100 threaded through holes in a bicycle frame 124 and a bicycle wheel/tire 126 to secure the bicycle 128 to a stationery object, in this case a pole 130.

Figure 4:
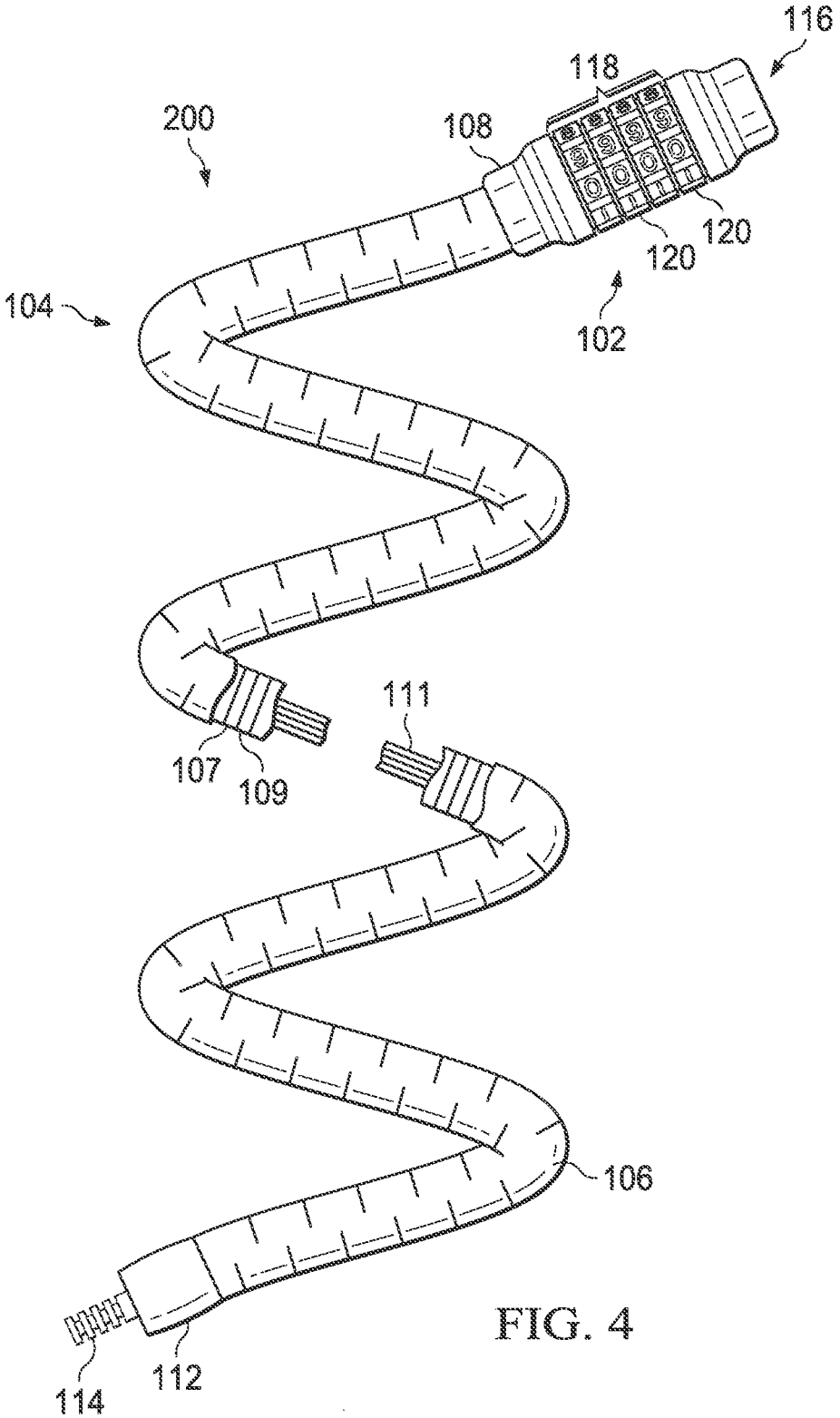
FIG. 4 shows a front view with portions broken away of a cable-style lock with a flexibly-obedient securing arm in accordance with another embodiment, the lock being in an unlocked condition.
Figure 5A:
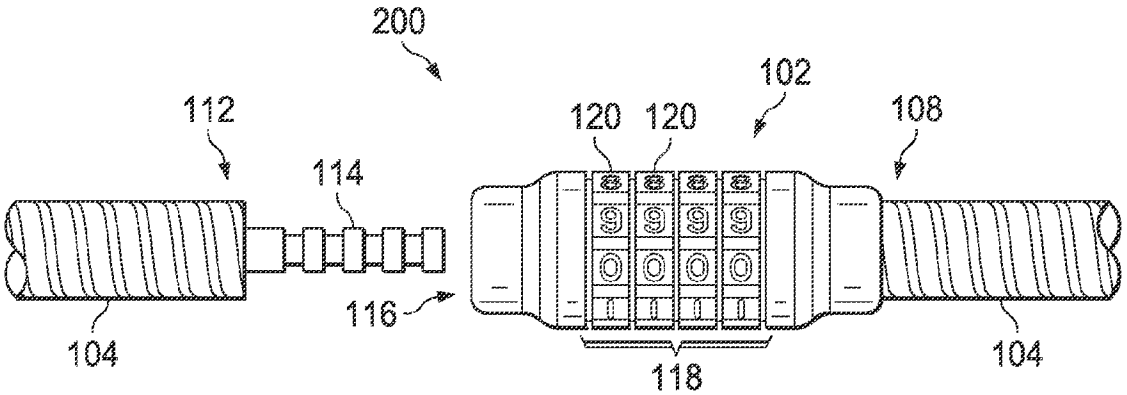
FIGS. 5A and 5B show an enlarged partial view of the lock mechanism portion of the lock of FIG. 4, respectively illustrating the lock in the unlocked condition in FIG. 5A and in the locked condition in FIG. 5B.
Figure 5B:
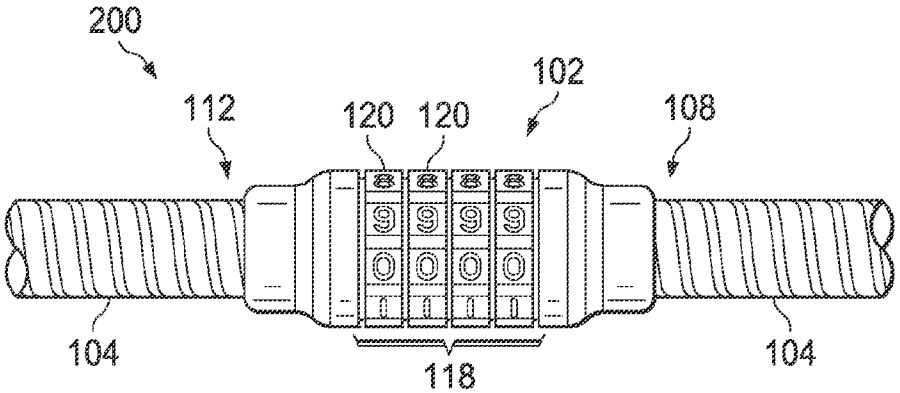

Referring now to FIGS. 4, 5A and 5B, there is illustrated a lock with flexibly-obedient securing arm in accordance with another aspect. The lock 200 is a coil-style lock (the securing arm 104 extends axially from the ends of the locking mechanism body 110) suitable for use as a bicycle lock. FIG. 4 presents a view of the lock 200 in the open and unlocked configuration. The lock 200 includes many elements that are substantially similar to those of shackle-style lock 100 previously described, and thus identically numbered elements may be considered substantially similar to those previously described unless otherwise noted.

The lock 200 includes a lock mechanism 102 and a flexibly-obedient securing arm 104. For purposes of illustration, the securing arm 104 in FIG. 4 is illustrated with portions broken away to show internal structure and with a break to indicate that the securing arm 104 may have a range of lengths in different embodiments. FIG. 4 also illustrates that the flexibly-obedient securing arm 104 may bend into any shape and will maintain such shape when the bending force is removed. FIG. 4 presents a view of the lock 200 as it might appear upon removal from a storage tube (FIG. 8), and also provides an example of the securing arm's ability to bend into and hold any shape. The lock 200 in this embodiment is fabricated from flexible gooseneck tubing, allowing it to uniquely bend into, and hold, any shape (non-recoiling). The lock 200 may have a flexibly-obedient securing arm 104 that measures from 7 feet (84 inches) to 15 feet (180 inches) in length, with an outer diameter ranging from 8 mm to 25 mm. In preferred embodiments, the outer diameter of the securing arm 104 is within the range from 20 mm to 25 mm (including the end points). Other embodiments may have a securing arm 104 with a different length and/or with a different outer diameter. The securing arm 104 may have an outer sheath 106 constructed from two or more interwound helically-wound or spirally-wound coil elements 107, 109 formed from a variety of metals including, but not limited to, brass, steel, stainless steel, titanium, bronze, iron, tin, or any combination thereof. The exterior of the lock 200, or portions thereof, may feature surface treatments including, but not limited to, electro-coating, plating, paints, plastics, or heat-shrink sleeve. Surface treatment designs are original, and designed to either enhance security and/or other elements of the lock 200.

Referring still to FIG. 4, and now also to FIGS. 5A and 5B, the interior of the securing arm 104 of the lock 200 is comprised of a reinforcing core 111 that may include, but is not limited to, steel, braided steel, titanium wire, glass fiber, aramid fiber, para-aramid fiber, Kevlar® brand poly paraphenylene terephthalamide fiber, carbon-Kevlar®, carbon nanotubes, or any combination thereof. In this embodiment, one end of the locking mechanism 102 (i.e., the "female" end) includes a stem receptacle portion 116 operatively connected to an actuator portion 118 having a resettable combination locking mechanism featuring at least four dials 120. The exterior of the dials 120 may feature a unique combination of numbers, letters and/or symbols for added security. The corresponding end 112 (i.e., the "male" end) of the securing arm 104 includes a stem portion 114 that slides into the stem receptacle portion 116 of the locking mechanism 102 when the actuator portion 118 is in the unlocked configuration, but that is captured and cannot be removed when the actuator portion is in the locked configuration.

Figure 6:
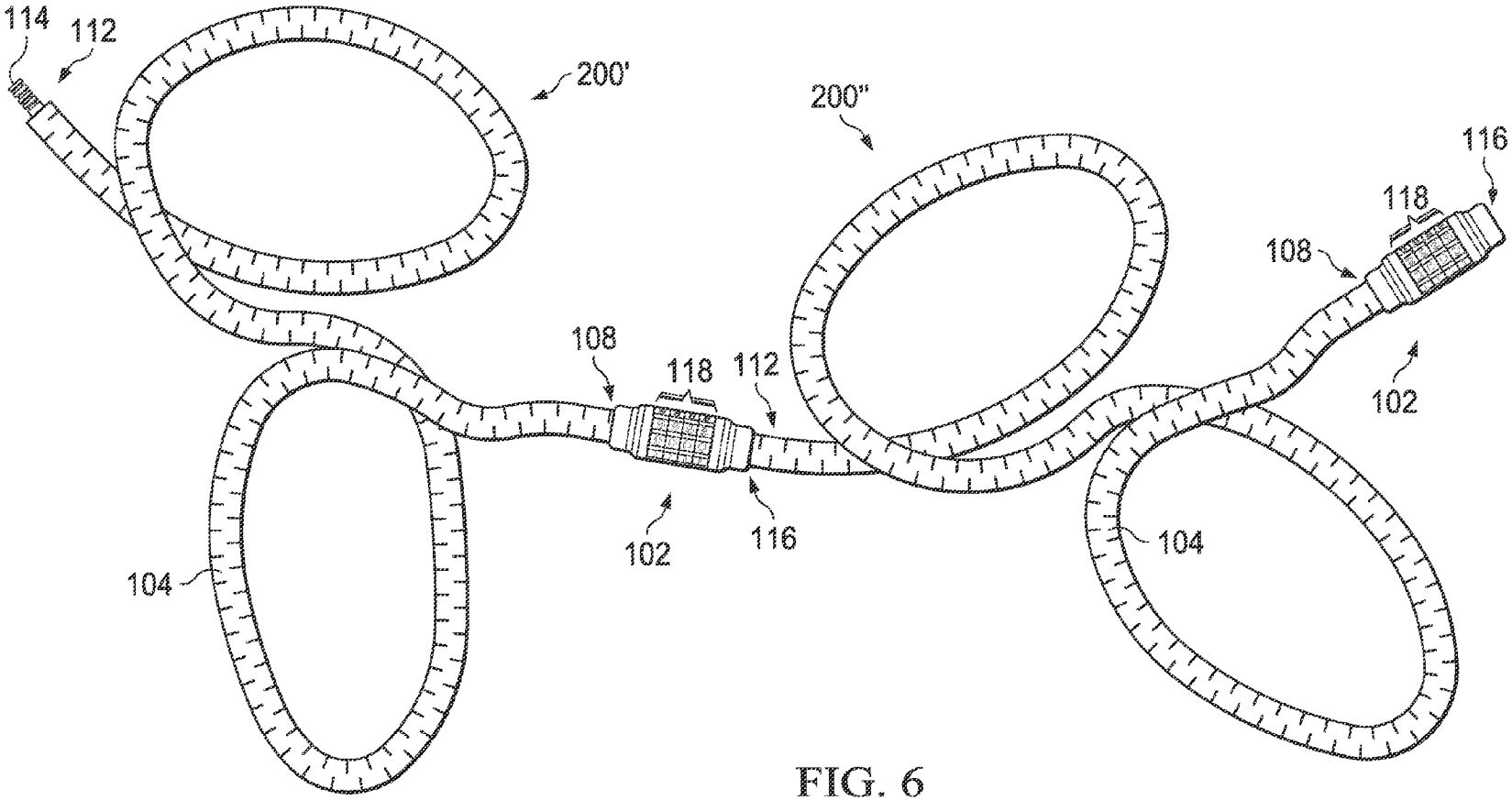
FIG. 6 shows two cable-style locks with flexibly-obedient securing arms interconnected in a "daisy-chain" arrangement to provided increased overall length in accordance with another aspect.

Referring now to FIG. 6, there are illustrated two identical locks 200, namely lock 200' and 200", which are interconnected in a "daisy chain" arrangement to increase the overall length of the flexibly-obedient securing arms 104. The illustrated interconnection is possible because the stem portions 114 of some embodiments are designed in such a way as to provide an interlocking capability with the stem receptacle portions 116 of similar locks.

Figure 7:
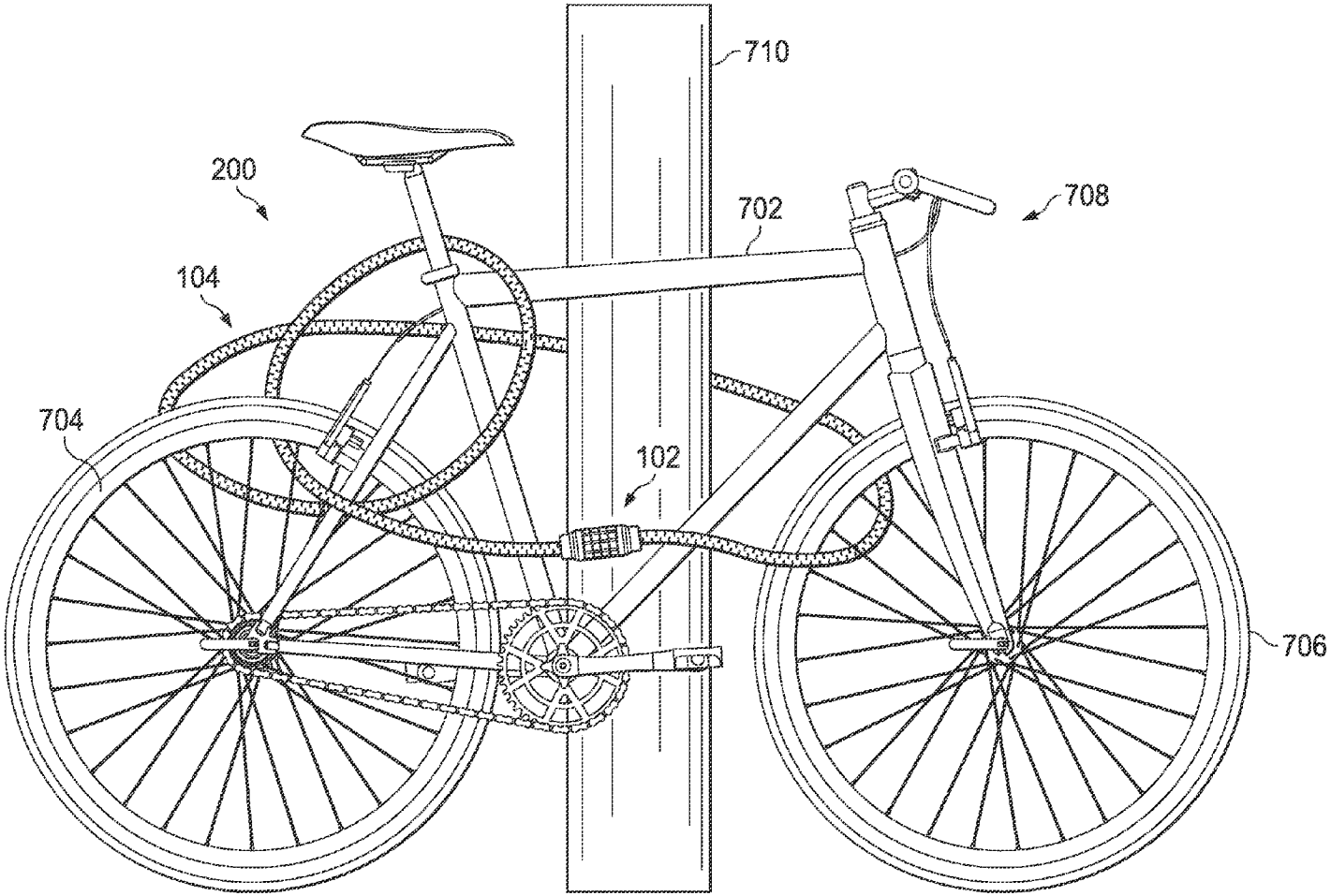
FIG. 7 shows the cable-style lock of FIG. 4 being used to secure a bicycle to an object in accordance with another aspect.

Referring now to FIG. 7, there is illustrated the cable-style lock 200 with flexibly-obedient securing arm 104 threaded through holes in a bicycle frame 702 and a bicycle wheels/tires 704, 706 to secure the bicycle 708 to a stationery object, in this case a pole 710.

Figure 8:
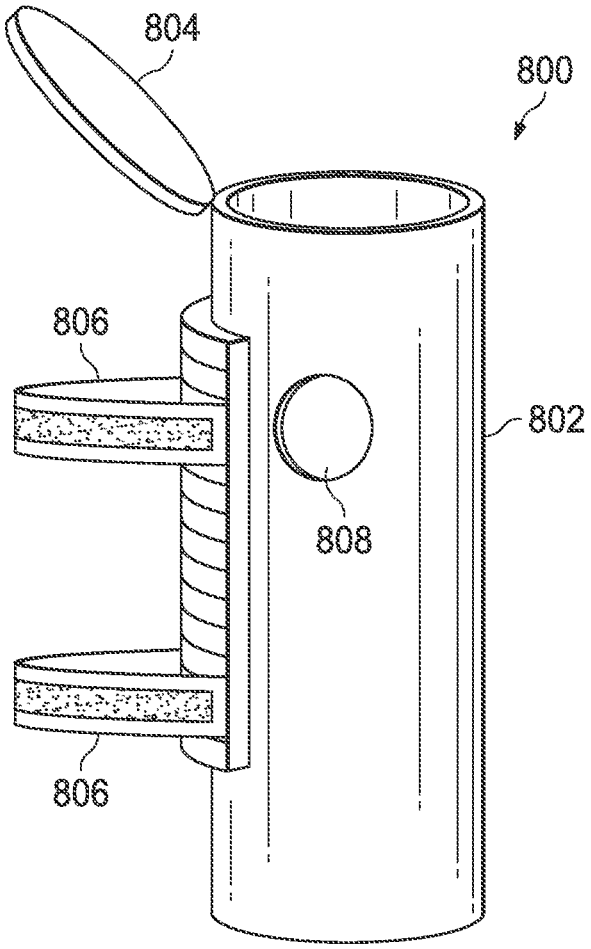
FIG. 8 illustrates a tube-shaped container for storing a lock with flexibly-obedient securing arm in accordance with another aspect.

Referring now to FIG. 8, there is illustrated a storage container 800 in accordance with another aspect. The storage container 800 is suitable for packaging and/or storing a lock with flexibly-obedient securing arm as previously described, e.g., lock 100 or lock 200. The storage container 800 has a cylindrical-shaped "tube" body 802 sized to contain a lock 100, 200 bent into a coiled configuration. The body 802 may be manufactured from a material including, but is not limited to, plastic, various metals, or any combination thereof. The storage container 800 may further comprises a flip-top lid 804, one or more detachable, adjustable straps 806 and a through-hole 808 formed in the body 802, which allows the storage container 800 to locked by the securing arm 104 of the lock.

Referring now to FIGS. 9-14, there are illustrated several enlarged partial cross-sectional side views of portions of the flexibly-obedient securing arm 104 of the lock 100 of FIG. 1 and/or lock 200 of FIG. 4, to better show the structure of the armored sheath 106 and reinforcing core 111 in accordance with additional aspects. It will be appreciated that the illustrated combinations of particular cross-sectional configurations of the armored sheath 106 and particular cross-sectional configurations of the reinforced core 111 are for example only, and that different combinations of these elements would be possible.

Figure 9:
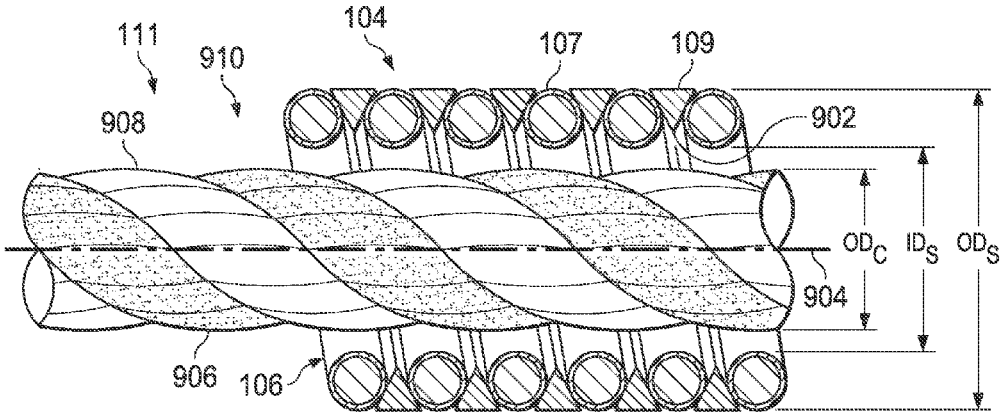
FIG. 9 is an enlarged partial cross-sectional side view of a portion of the flexibly-obedient securing arm of the lock of FIG. 1 or FIG. 4 in accordance with one embodiment.
Figure 10:
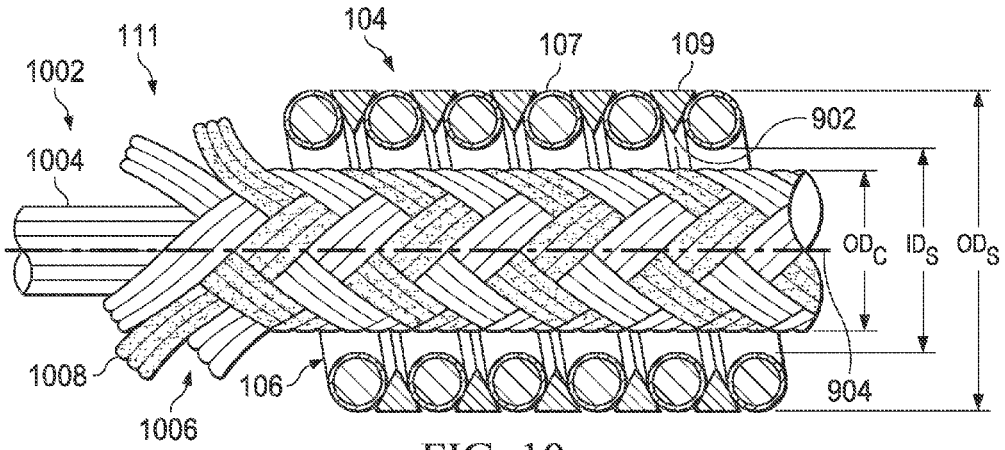
FIG. 10 is an enlarged partial cross-sectional side view of a portion of the flexibly-obedient securing arm of the lock of FIG. 1 or FIG. 4 in accordance with another embodiment.
Figure 11:
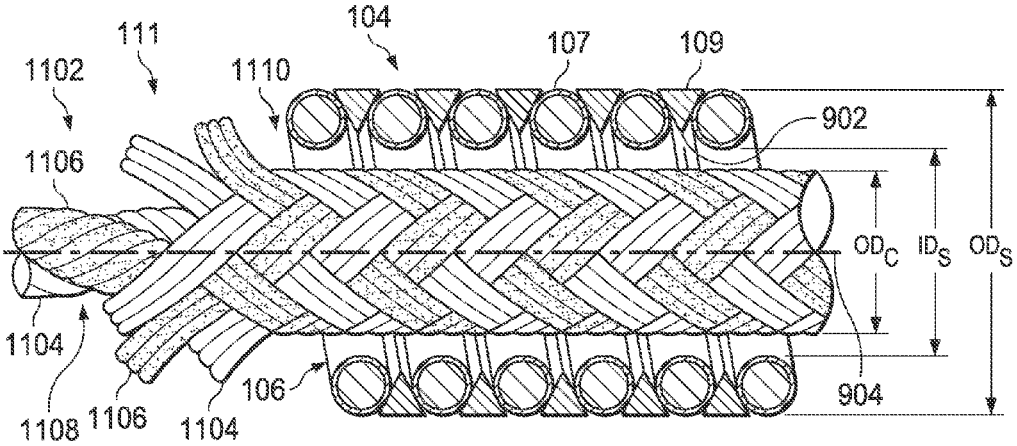
FIG. 11 is an enlarged partial cross-sectional side view of a portion of the flexibly-obedient securing arm of the lock of FIG. 1 or FIG. 4 in accordance with yet another embodiment.

In particular, FIGS. 9-11 illustrate a portion of the flexibly-obedient securing arm 104 of the lock 100, 200 wherein the armored sheath 106 includes a base-wire coil 107 formed of a helically-wound metallic wire having a round cross-section and a packing-wire coil 109 formed of a helically-wound metallic strip having a triangular cross-section. The base-wire coil 107 and the packing-wire coil 109 are interleaved with an apex 902 of the triangular cross-section of the packing-wire coil inwardly oriented toward a centerline 904 of the flexible metallic tubing between directly successive turns of the base-wire coil.

Referring now specifically to FIG. 9, in the illustrated embodiment, the reinforcing core 111 includes at least one bundle 906 of non-metallic fiber material having a tensile strength-to-weight ratio of at least 1000 kN·m/Kg and at least one bundle 908 of metallic wire. The bundle of metallic wire 908 is twisted with the bundle of non-metallic fiber material 906 to form a rope 910 of metallic wire and non-metallic fiber material. In another embodiment, the reinforcing core 111 includes at least one bundle 906 of non-metallic fiber material having a tensile strength-to-weight ratio of at least 2000 kN·m/Kg and at least one bundle 908 of metallic wire. In the illustrated embodiment, the wire and/or fibers forming the rope 910 are twisted, but in other embodiments the wire and/or fibers forming the rope may be woven or braided. The armored sheath 106 has an outer diameter, $OD_S$, and an inner diameter, $ID_S$, and the reinforcing core 111 has an outer diameter, $OD_C$. In the illustrated embodiment, the value of $OD_S$ is within the range from 20 mm to 25 mm (including the end points), and the value of $OD_C$ is within the range from 75% to 98% (including the end points) of the value of the $ID_S$. In other embodiments, other values of $OD_S$ and $ID_S$ may be used. This size range for the core $OD_C$ relative to the sheath $ID_S$ provides a core with good cut and crush resistance, but which does not interfere with bending of the armored sheath.

Referring specifically to FIG. 10, in the illustrated embodiment, the reinforcing core 111 includes an inner core 1002 including at least one bundle 1004 of metallic wire and an outer core 1006 including a plurality of bundles 1008 of non-metallic fiber material having a tensile strength-to-weight ratio of at least 1000 kN·m/Kg. The plurality of bundles 1008 of non-metallic fiber material are woven around the metallic wire of the inner core 1002. In another embodiment, the outer core 1006 includes a plurality of bundles 1008 of non-metallic fiber material having a tensile strength-to-weight ratio of at least 2000 kN·m/Kg. In the illustrated embodiment, the wire and/or fibers forming the inner core 1002 are untwisted, but in other embodiments the wire and/or fibers forming the inner core may be twisted, woven or braided. The armored sheath 106 has an outer diameter, $OD_S$, and an inner diameter, $ID_S$, and the reinforcing core 111 has an outer diameter, $OD_C$ (i.e., the diameter of the outer core 1006). In the illustrated embodiment, the value of $OD_S$ is within the range from 20 mm to 25 mm (including the end points), and the value of $OD_C$ is within the range from 75% to 98% (including the end points) of the value of the $ID_S$. In other embodiments, other values of $OD_S$ and $ID_S$ may be used.

Referring now specifically to FIG. 11, in the illustrated embodiment, the reinforcing core 111 includes an inner core 1102 formed from a plurality of bundles of metallic wire 1104 and/or non-metallic fiber material 1106 having a tensile strength-to-weight ratio of at least 1000 kN·m/Kg twisted into a rope 1108. The reinforcing core 111 further includes an outer core 1110 formed from a plurality of bundles of metallic wire 1104 and/or of non-metallic fiber material 1106 woven around the rope 1108 of the inner core 1102. In another embodiment, the non-metallic fiber material of the bundles 1106 has a tensile strength-to-weight ratio of at least 2000 kN·m/Kg. In the illustrated embodiment, the wire and/or fibers forming the rope 1108 are twisted, but in other embodiments the wire and/or fibers forming the rope may be woven or braided. The armored sheath 106 has an outer diameter, $OD_S$, and an inner diameter, $ID_S$, and the reinforcing core 111 has an outer diameter, $OD_C$ (i.e., the diameter of the outer core 1110). In the illustrated embodiment, the value of $OD_S$ is within the range from 20 mm to 25 mm (including the end points), and the value of $OD_C$ is within the range from 75% to 98% (including the end points) of the value of the $ID_S$. In other embodiments, other values of $OD_S$ and $ID_S$ may be used. In a preferred embodiment, the helically-wound metallic wires 107, 109 of the annular wall of the armored sheath 106 are formed of steel, at least some of the bundles of the inner core 1102 are formed of steel wire; and at least some of the bundles of the outer core 1110 are formed of an aramid or para-aramid fiber material.

Figure 12:
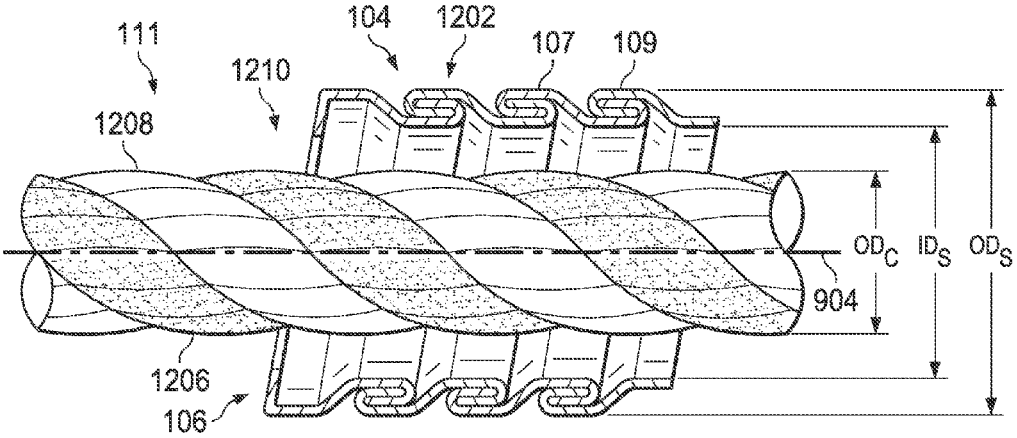
FIG. 12 is an enlarged partial cross-sectional side view of a portion of the flexibly-obedient securing arm of the lock of FIG. 1 or FIG. 4 in accordance with still another embodiment.
Figure 13:
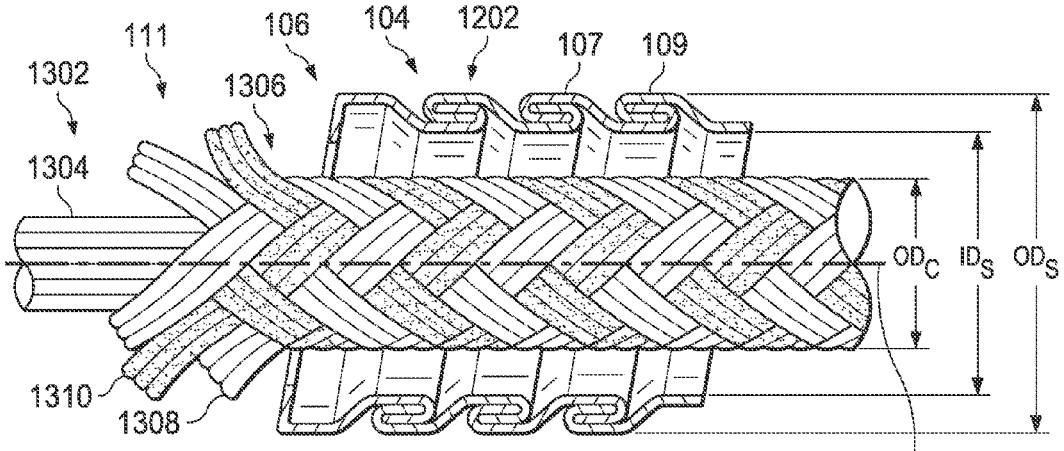
FIG. 13 is an enlarged partial cross-sectional side view of a portion of the flexibly-obedient securing arm of the lock of FIG. 1 or FIG. 4 in accordance with a further embodiment.
Figure 14:
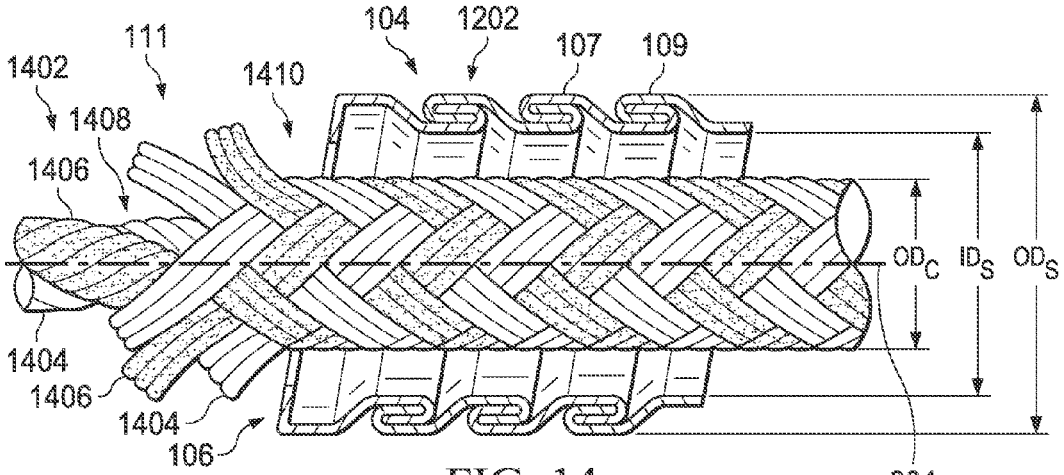
FIG. 14 is an enlarged partial cross-sectional side view of a portion of the flexibly-obedient securing arm of the lock of FIG. 1 or FIG. 4 in accordance with a still further embodiment.

In particular, FIGS. 12-14 illustrate a portion of the flexibly-obedient securing arm 104 of the lock 100, 200 wherein the armored sheath 106 includes spirally-wound metallic strips 107, 109 having sliding joints 1202 between adjacent turns thereof formed by overlapping and crimping or interlocking adjacent edges.

Referring now specifically to FIG. 12, in the illustrated embodiment, the reinforcing core 111 includes at least one bundle 1206 of non-metallic fiber material having a tensile strength-to-weight ratio of at least 1000 kN·m/Kg and at least one bundle 1208 of metallic wire. The bundle of metallic wire 1208 is twisted with the bundle of non-metallic fiber material 1206 to form a rope 1210 of metallic wire and non-metallic fiber material. In another embodiment, the reinforcing core 111 includes at least one bundle 1206 of non-metallic fiber material having a tensile strength-to-weight ratio of at least 2000 kN·m/Kg and at least one bundle 1208 of metallic wire. In the illustrated embodiment, the wire and/or fibers forming the rope 1210 are twisted, but in other embodiments the wire and/or fibers forming the rope may be woven or braided. The armored sheath 106 has an outer diameter, $OD_S$, and an inner diameter, $ID_S$, and the reinforcing core 111 has an outer diameter, $OD_C$. In the illustrated embodiment, the value of ODs is within the range from 20 mm to 25 mm (including the end points), and the value of $OD_C$ is within the range from 75% to 98% (including the end points) of the value of the $ID_S$. In other embodiments, other values of $OD_S$ and $ID_S$ may be used.

Referring specifically to FIG. 13, in the illustrated embodiment, the reinforcing core 111 includes an inner core 1302 including at least one bundle 1304 of metallic wire and an outer core 1306 including a plurality of bundles of metallic wire 1308 and/or of non-metallic fiber material 1310 having a tensile strength-to-weight ratio of at least 1000 kN·m/Kg.

The plurality of bundles metallic wire 1308 and/or of non-metallic fiber material 1310 are woven around the metallic wire of the inner core 1302. In another embodiment, the outer core 1306 includes a plurality of bundles 1310 of non-metallic fiber material having a tensile strength-to-weight ratio of at least 2000 kN·m/Kg. In the illustrated embodiment, the wire and/or fibers forming the inner core 1302 are untwisted, but in other embodiments the wire and/or fibers forming the inner core may be twisted, woven or braided. The armored sheath 106 has an outer diameter, $OD_S$, and an inner diameter, $ID_S$, and the reinforcing core 111 has an outer diameter, $OD_C$ (i.e., the diameter of the outer core 1006). In the illustrated embodiment, the value of $OD_S$ is within the range from 20 mm to 25 mm (including the end points), and the value of $OD_C$ is within the range from 75% to 98% (including the end points) of the value of the $ID_S$. In other embodiments, other values of $OD_S$ and $ID_S$ may be used.

Referring now specifically to FIG. 14, in the illustrated embodiment, the reinforcing core 111 includes an inner core 1402 formed from a plurality of bundles of metallic wire 1404 and/or non-metallic fiber material 1406 having a tensile strength-to-weight ratio of at least 1000 kN·m/Kg twisted into a rope 1408. The reinforcing core 111 further includes an outer core 1410 formed from a plurality of bundles of metallic wire 1404 and/or of non-metallic fiber material 1406 woven around the rope 1408 of the inner core 1402. In another embodiment, the non-metallic fiber material of the bundles 1406 has a tensile strength-to-weight ratio of at least 2000 kN·m/Kg. In the illustrated embodiment, the wire and/or fibers forming the rope 1408 are twisted, but in other embodiments the wire and/or fibers forming the rope may be woven or braided. The armored sheath 106 has an outer diameter, $OD_S$, and an inner diameter, $ID_S$, and the reinforcing core 111 has an outer diameter, $OD_C$ (i.e., the diameter of the outer core 1110). In the illustrated embodiment, the value of $OD_S$ is within the range from 20 mm to 25 mm (including the end points), and the value of $OD_C$ is within the range from 75% to 98% (including the end points) of the value of the $ID_S$. In other embodiments, other values of $OD_S$ and $ID_S$ may be used. In a preferred embodiment, the spirally-wound metallic strips 107, 109 of the annular wall of the armored sheath 106 are formed of steel, at least some of the bundles of the inner core 1402 are formed of steel wire; and at least some of the bundles of the outer core 1410 are formed of an aramid or para-aramid fiber material.

It will be appreciated that in other embodiments, different configurations of gooseneck tubing may be used in place of the tubing shown in FIGS. 9-14, provided such tubing is flexibly-obedient as described herein.

It will further be appreciated by those skilled in the art having the benefit of this disclosure that this lock with flexibly obedient securing arm provides a lock of improved design for securing bicycles and other property. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A lock apparatus for securing one or more objects to be secured to a stationery object, the lock apparatus comprising:

a locking mechanism including a body;

a stem receptacle portion disposed in the body and having an internal profile changeable between a locked profile and an unlocked profile;

an actuator portion disposed on the body and having a configuration selectively movable between a locked configuration and an unlocked configuration; and the actuator portion being operatively connected to the stem receptacle portion to change the internal profile of the stem receptacle portion into the locked profile when the actuator portion is moved to the locked configuration and to change the internal profile of the stem receptacle portion into the unlocked profile when the actuator portion is moved to the unlocked configuration;

an elongated securing arm including a first end having a stem portion configured for removable insertion into the stem receptacle portion of the locking mechanism, the stem portion, when inserted into the stem receptacle portion, being removable from the stem receptacle portion when the internal profile is the unlocked profile, and the stem portion, when inserted into the stem receptacle portion, being non-removably connected to the stem receptacle portion when the internal profile is the locked profile;

a second end spaced apart from the first end, the second end being connected to the body of the locking mechanism;

an armored sheath extending between the first end and the second end, the armored sheath formed of flexible metallic tubing having an annular wall defining a continuous interior cavity, the annular wall of the flexible metallic tubing including at least two helically-wound metallic wires, rods, strips or ribbons interwound with one another such that successive coils of a first wire, rod, strip or ribbon are interleaved with successive coils of a second wire, rod, strip or ribbon to form a cross-sectional configuration, the cross-sectional configuration of the flexible metallic tubing being flexibly obedient such that the armored sheath is reconfigurable into multiple curved positions by the manual application of bending force and holds the curved positions after the bending force is removed until it is manually bent again, the cross-sectional configuration of the flexible metallic tubing further defining an outer diameter and an inner diameter of the armored sheath; and a reinforcing core disposed within the interior cavity of the armored sheath between the first end and the second end, the reinforcing core having an outer diameter and including at least one bundle of non-metallic fiber material having a tensile strength-to-weight ratio of at least 1000 kN·m/Kg, the reinforcing core being sufficiently flexible to maintain the curved positions of the flexibly-obedient armored sheath after the bending force is removed.

2. A lock apparatus in accordance with claim 1, wherein the annular wall of the flexible metallic tubing includes:

a base-wire coil formed of a helically-wound metallic wire having a round cross-section; and a packing-wire coil formed of a helically-wound metallic strip having a triangular cross-section, wherein the base-wire coil and the packing-wire coil are interleaved with an apex of the triangular cross-section of the packing-wire coil inwardly oriented toward a centerline of the flexible metallic tubing between directly successive turns of the base-wire coil.

3. A lock apparatus in accordance with claim 2, wherein the reinforcing core further comprises:

at least one bundle of metallic wire; and the bundle of metallic wire being twisted with the bundle of non-metallic fiber material to form a rope of metallic wire and non-metallic fiber material.

4. A lock apparatus in accordance with claim 2, wherein the reinforcing core further comprises:

an inner core including at least one bundle of metallic wire; and an outer core including a plurality of bundles of non-metallic fiber material having a tensile strength-to-weight ratio of at least 1000 kN·m/Kg woven around the metallic wire of the inner core.

5. A lock apparatus in accordance with claim 2, wherein the reinforcing core further comprises:

an inner core formed from a plurality of bundles of metallic wire or non-metallic fiber material having a tensile strength-to-weight ratio of at least 1000 kN·m/Kg twisted into a rope; and an outer core formed from a plurality of bundles of metallic wire or non-metallic fiber material having a tensile strength-to-weight ratio of at least 1000 kN·m/Kg woven around the rope of the inner core.

6. A lock apparatus in accordance with claim 5, wherein:

the helically-wound metallic wires, rods, strips or ribbons of the annular wall of the flexible metallic tubing are formed of steel;

at least some of the bundles of the inner core are formed of steel wire; and at least some of the bundles of the outer core are formed of an aramid or para-aramid fiber material.

7. A lock apparatus in accordance with claim 1, wherein the annular wall of the flexible metallic tubing includes a pair of spirally-wound metallic strips having sliding joints between adjacent turns thereof formed by overlapping and crimping or interlocking adjacent edges.

8. A lock apparatus in accordance with claim 7, wherein the reinforcing core further comprises:

at least one bundle of metallic wire or another bundle of non-metallic fiber having a tensile strength-to-weight ratio of at least 1000 kN·m/Kg; and the bundles are twisted together to form a rope.

9. A lock apparatus in accordance with claim 7, wherein the reinforcing core further comprises:

an inner core including at least one bundle of metallic wire; and an outer core including a plurality of bundles of metallic wire or non-metallic fiber material having a tensile strength-to-weight ratio of at least 1000 kN·m/Kg woven around the metallic wire of the inner core.

10. A lock apparatus in accordance with claim 7, wherein the reinforcing core further comprises:

an inner core formed from a plurality of bundles of metallic wire or non-metallic fiber material having a tensile strength-to-weight ratio of at least 1000 kN·m/Kg twisted into a rope; and an outer core formed from a plurality of bundles of metallic wire or non-metallic fiber material having a tensile strength-to-weight ratio of at least 1000 kN·m/Kg woven around the rope of the inner core.

11. A lock apparatus in accordance with claim 1, wherein the actuator portion of the locking mechanism comprises a key-operated pin-tumbler lock.

12. A lock apparatus in accordance with claim 1, wherein the actuator portion of the locking mechanism comprises a multiple-dial combination lock.

13. A lock apparatus in accordance with claim 1, wherein the body defines a longitudinal axis passing therethrough, and at least one of the first and second ends of the flexibly-obedient securing arm is connected to the body in a direction perpendicular to the longitudinal axis, thereby constituting a shackle-type lock.

14. A lock apparatus in accordance with claim 1, wherein the body defines a longitudinal axis passing therethrough, and both the first and second ends of the flexibly-obedient securing arm are connected to the body in a direction parallel to the longitudinal axis, thereby constituting a cable-type lock.

15. A lock apparatus for securing one or more objects to be secured to a stationery object, the lock apparatus comprising:

a locking mechanism including an actuator portion operatively connected to a stem receptacle portion to change an internal profile of the stem receptacle portion into a locked profile when the actuator portion is moved into a locked configuration and to change the internal profile of the stem receptacle portion into an unlocked profile when the actuator portion is moved to an unlocked configuration;

an elongated securing arm including a first end having a stem portion configured for removable insertion into the stem receptacle portion of the locking mechanism, the stem portion being removable from the stem receptacle portion when the internal profile is the unlocked profile, but being non-removably connected to the stem receptacle portion when the internal profile is the locked profile;

a second end spaced apart from the first end, the second end being connected to the body of the locking mechanism;

an armored sheath extending between the first end and the second end, the armored sheath having an annular wall defining a continuous interior cavity and including at least two spirally-wound metallic strips interwound with one another to form a cross-sectional configuration, the cross-sectional configuration of the armored sheath being flexibly obedient such that the armored sheath is reconfigurable into multiple curved positions by the manual application of bending force and holds the curved positions after the bending force is removed until it is manually bent again, the cross-sectional configuration of the armored sheath further defining an outer diameter and an inner diameter; and a reinforcing core disposed within the interior cavity of the armored sheath between the first and second ends, the reinforcing core having an outer diameter within the range from 75% to 95% of the inner diameter of the armored sheath and including at least one bundle of elongated non-metallic fiber material having a tensile strength-to-weight ratio of at least 1000 kN·m/Kg extending between the first and second ends.

16. A lock apparatus in accordance with claim 15, wherein the armored sheath of the flexibly-obedient securing arm has an outer diameter of 20 mm or greater.

17. A lock apparatus in accordance with claim 15, wherein the armored sheath of the flexibly-obedient securing arm is formed from at least one of steel, stainless steel, magnesium steel, titanium, iron, brass, bronze and tin.

18. A lock apparatus in accordance with claim 15, wherein the reinforcing core is formed from at least one of steel wire, braided steel wire, titanium wire, glass fiber, carbon fiber, aramid fiber, para-aramid fiber and poly paraphenylene terephthalamide fiber.

19. A bicycle lock apparatus for securing a bicycle to a stationery object, the bicycle lock apparatus comprising:

a locking mechanism selectively changeable between a locked configuration and an unlocked configuration;

an elongated securing arm including a first end adapted for removable insertion into the locking mechanism when the locking mechanism is in the unlocked configuration, but for non-removable connection to the locking mechanism when the locking mechanism is in the locked configuration;

a second end spaced apart from the first end and connected to the locking mechanism;

an armored sheath extending a length of at least seven feet between the first end and the second end, the armored sheath having an annular wall formed from at least two spirally-wound metallic strips interwound with one another to define a continuous interior cavity, the armored sheath being flexibly obedient such that the armored sheath is reconfigurable into multiple curved positions by the manual application of bending force and holds the curved positions after the bending force is removed until it is manually bent again, the armored sheath further defining an outer diameter and an inner diameter; and a reinforcing core disposed within the interior cavity of the armored sheath between the first and second ends, the reinforcing core including at least one bundle of elongated non-metallic fiber material having a tensile strength-to-weight ratio of at least 1000 kN·m/Kg extending between the first and second ends.

* * * * *